US008339049B2

(12) United States Patent
Kang et al.

(10) Patent No.: US 8,339,049 B2
(45) Date of Patent: Dec. 25, 2012

(54) LED DRIVING CIRCUIT HAVING A LARGE OPERATIONAL RANGE IN VOLTAGE

(75) Inventors: Chin-Feng Kang, Hsin-Chu (TW); Meng-Hung Lin, Hsin-Chu (TW)

(73) Assignee: Analog Integrations Corporation, Hsin-Chu (TW)

( * ) Notice: Subject to any disclaimer, the term of this patent is extended or adjusted under 35 U.S.C. 154(b) by 390 days.

(21) Appl. No.: 12/638,971

(22) Filed: Dec. 15, 2009

(65) Prior Publication Data

US 2011/0084618 A1 Apr. 14, 2011

(30) Foreign Application Priority Data

Oct. 14, 2009 (TW) ..... 98134750 A

(51) Int. Cl.
*H05B 37/02* (2006.01)

(52) U.S. Cl. ..... 315/185 R; 315/291

(58) Field of Classification Search .... 315/169.1–169.4, 315/185 R, 186, 193, 209 R, 210, 215–217, 315/291, 307, 312, 361, 362; 345/76, 77, 345/82, 84, 102, 204, 211–214
See application file for complete search history.

(56) References Cited

U.S. PATENT DOCUMENTS

| | | | | |
|---|---|---|---|---|
| 5,959,413 | A * | 9/1999 | Komarek et al. | 315/306 |
| 7,088,334 | B2 * | 8/2006 | Adachi et al. | 345/102 |
| 7,646,154 | B2 * | 1/2010 | Kang et al. | 315/312 |
| 7,781,979 | B2 * | 8/2010 | Lys | 315/185 S |
| 7,994,725 | B2 * | 8/2011 | Bouchard | 315/122 |
| 2012/0081009 | A1 * | 4/2012 | Shteynberg et al. | 315/122 |

* cited by examiner

*Primary Examiner* — Jimmy Vu
(74) *Attorney, Agent, or Firm* — Winston Hsu; Scott Margo

(57) ABSTRACT

An LED driving circuit includes a current selecting circuit. The current selecting circuit controls the current transmission path in the plurality of LEDs according to respective threshold voltages of corresponding LEDs and a plurality of current limits.

15 Claims, 6 Drawing Sheets

LED DRIVING CIRCUIT HAVING A LARGE OPERATIONAL RANGE IN VOLTAGE

BACKGROUND OF THE INVENTION

1. Field of the Invention

The present invention is related to an LED driving circuit, and more particularly, to an LED driving circuit having a large operational voltage range.

2. Description of the Prior Art

Compared to incandescent lamps, light emitting diodes (LEDs) are characterized in low power consumption, long lifetime, small size and fast optical response. LEDs can easily be manufactured as miniaturized or array devices, which are widely used in various electronic products. Common LED applications include outdoor stationary displays (such as billboards, signboards or traffic signs) and portable devices (such as mobile phones, notebook computers or PDAs).

Reference is made to FIG. 1 for a voltage-current chart of an LED. When the forward-bias voltage of the LED is smaller than its threshold voltage Vb, the LED only conducts a negligible amount of current and the two ends of the LED are substantially open-circuited. When the forward-bias voltage of the LED is larger than its threshold voltage Vb, the current flowing through the LED exponentially increases with the forward-bias voltage and the two ends of the LED are substantially short-circuited. In an LED driving circuit, a current source is normally adopted for driving multiple LEDs so as to provide uniform luminescence.

Reference is made to FIG. 2 for a diagram of a prior art LED driving circuit 300. The LED driving circuit 300, including a voltage source VS and a current source IS, is configured to drive a luminescent device 10. The voltage source VS can provide a driving voltage Vf for turning on the luminescent device 10, while the current source IS can stabilize a driving current If which flows through the luminescent device 10 so as to maintain uniform luminescence. Since the LED is a current-driven device whose luminescence is proportional to its driving current, the luminescent device 10 normally includes a plurality of serially-coupled light-emitting diodes $LED_1$-$LED_n$ in order to provide sufficient and uniform light in large-size applications. Assuming all the light-emitting diodes $LED_1$-$LED_n$ have the ideal threshold voltage Vb, then a driving voltage Vf equal to n*Vb is required for turning on the luminescent device 10. In the prior art LED driving circuit 100, while more light-emitting diodes can provide higher light intensity, the forward-bias voltage of the luminescent device 10 also increases accordingly, thereby reducing the effective operational voltage range.

Reference is made to FIG. 3 for a diagram of another prior art LED driving circuit 400. The LED driving circuit 400, including a power supply circuit 110, a voltage detecting circuit 410 and a current-regulating circuit 420, is configured to drive a luminescent device 10. The power supply circuit 110 includes a voltage source VS and a bridge rectifier 20. The voltage source VS can output an alternating current (AC) voltage which periodically switches between positive and negative phases, while the bridge rectifier 20 is configured to convert the AC voltage outputted in the negative phase. The power supply circuit 110 can thus provide a direct current (DC) voltage Vf for driving the luminescent device 10, wherein the value of the driving voltage Vf periodically varies with time. The current-regulating circuit 420 includes a plurality of current sources $IS_1$-$IS_n$ respectively configured to control the light intensity of corresponding light-emitting diodes $LED_1$-$LED_n$ in the luminescent device 10. The voltage detecting circuit 410 can detect the value of the driving voltage Vf, thereby turning on/off the current sources $IS_1$-$IS_n$ of the current-regulating circuit 420 accordingly. Assuming all the light-emitting diodes $LED_1$-$LED_n$ have the ideal threshold voltage Vb: when the driving voltage Vf reaches the threshold voltage (Vb) of the light-emitting diode $LED_1$, the voltage detecting circuit 410 turns on the current source $IS_1$ and turns off the current sources $IS_2$-$IS_n$, thereby providing a current path which starts from the voltage source VS and sequentially passes through the light-emitting diode $LED_1$ and the current sources $IS_1$; when the driving voltage Vf reaches the overall threshold voltage of the light-emitting diodes $LED_1$ and $LED_2$ (2Vb), the voltage detecting circuit 410 turns on the current source $IS_2$ and turns off the current sources $IS_1$ and $IS_3$-$IS_n$, thereby providing a current path which starts from the voltage source VS and sequentially passes through the light-emitting diode $LED_1$, the light-emitting diode $LED_2$ and the current sources $IS_2$; . . . ; similarly, when the driving voltage Vf reaches the overall threshold voltage of the light-emitting diodes $LED_1$-$LED_n$ (n*Vb), the voltage detecting circuit 410 turns on the current source $IS_n$ and turns off the current sources $IS_1$-$IS_{n-1}$, thereby providing a current path which starts from the voltage source VS and sequentially passes through the light-emitting diodes $LED_1$-$LED_n$ and the current sources $IS_n$.

However, due to variations in material and manufacturing processes, the light-emitting diodes $LED_1$-$LED_n$ may not have the ideal threshold voltage Vb. The prior art voltage detecting circuit 410 is unable to control each current source according to the actual threshold voltage of a corresponding light-emitting diode. For example, assuming the actual threshold voltage Vb1 of the light-emitting diode $LED_1$ is larger than the ideal threshold voltage Vb. If the voltage detecting circuit 410 turns on the current source $IS_1$ when Vf=Vb, the light-emitting diode $LED_1$ cannot be turned on. Thus for non-ideal light-emitting diodes, the voltage detecting circuit 410 is normally configured to turn on the current source $IS_1$ when the detected driving voltage Vf reaches a switching voltage Vb' larger than Vb. If the voltage detecting circuit 410 turns on the current source $IS_1$ until Vf=Vb', the extra voltage (Vb'−Vb1) not only increases the power consumption of the current source $IS_1$, but also reduces the effective operational voltage range of the LED driving circuit 400.

SUMMARY OF THE INVENTION

The present invention provides a driving circuit having a large operational voltage range and configured to drive a plurality of serially-coupled luminescent units. The driving circuit comprises a current-selecting circuit configured to control current paths in the plurality of luminescent units according to a plurality of current limits and respective threshold voltages of corresponding light emitting diodes in the plurality of luminescent units.

The present invention further provides a display device having a large operational voltage range and comprising a plurality of serially-coupled luminescent units; a power supply circuit coupled to plurality of serially-coupled luminescent units; and a driving circuit configured to drive the plurality of serially-coupled luminescent units. The driving circuit comprises a current-selecting circuit configured to control current paths in the plurality of luminescent units according to a plurality of current limits and respective threshold voltages of corresponding light emitting diodes in the plurality of luminescent units.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
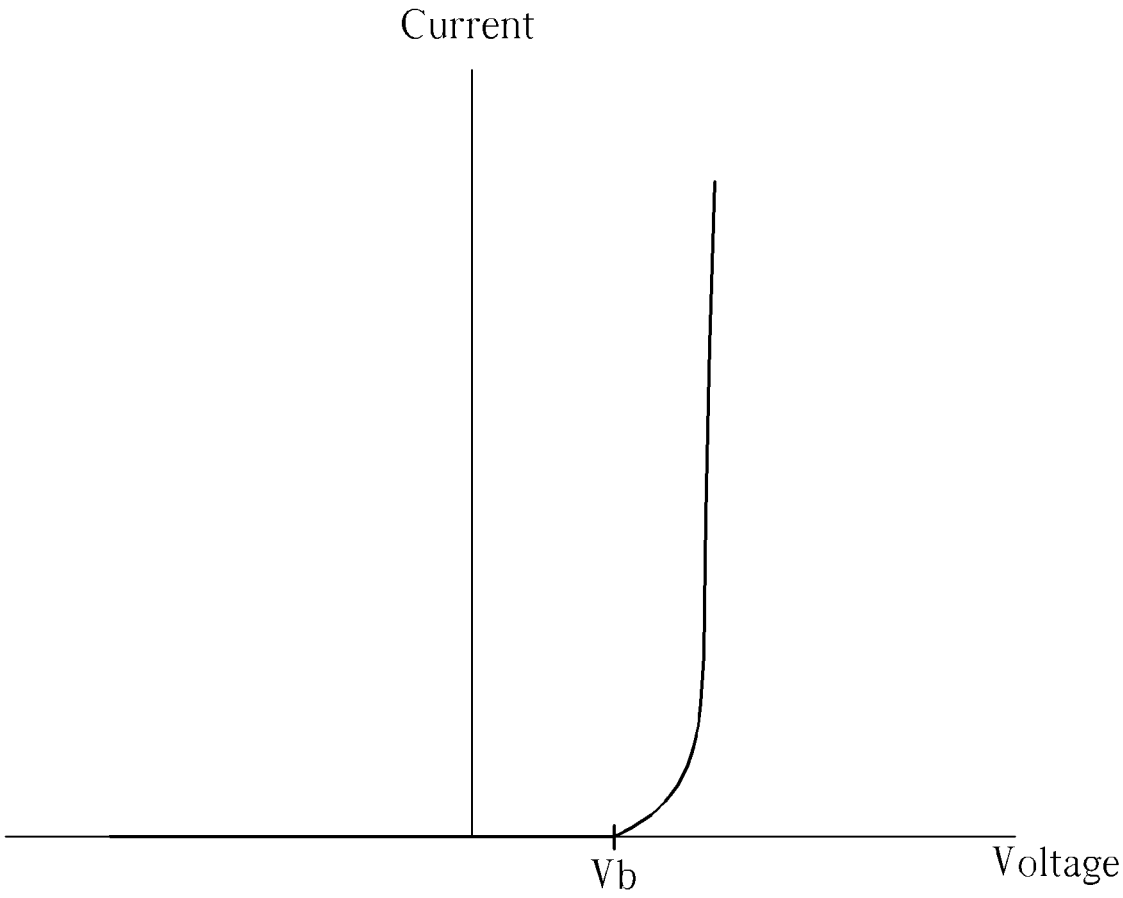
FIG. 1 PRIOR ART
FIG. 1 is a voltage-current chart of an LED.
Figure 2:
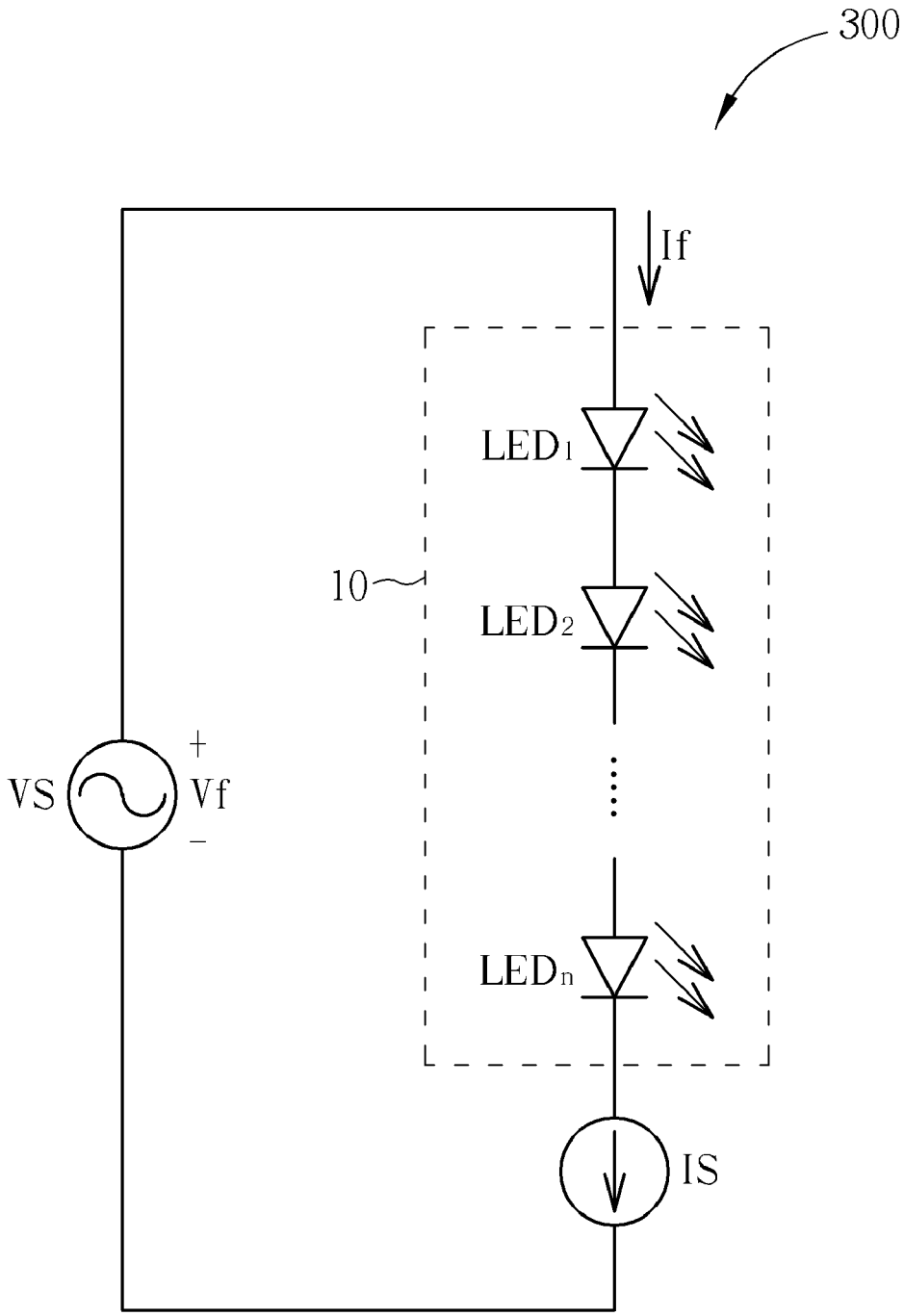
FIG. 2 PRIOR ART
FIG. 2 is a diagram of a prior art LED driving circuit.
Figure 3:
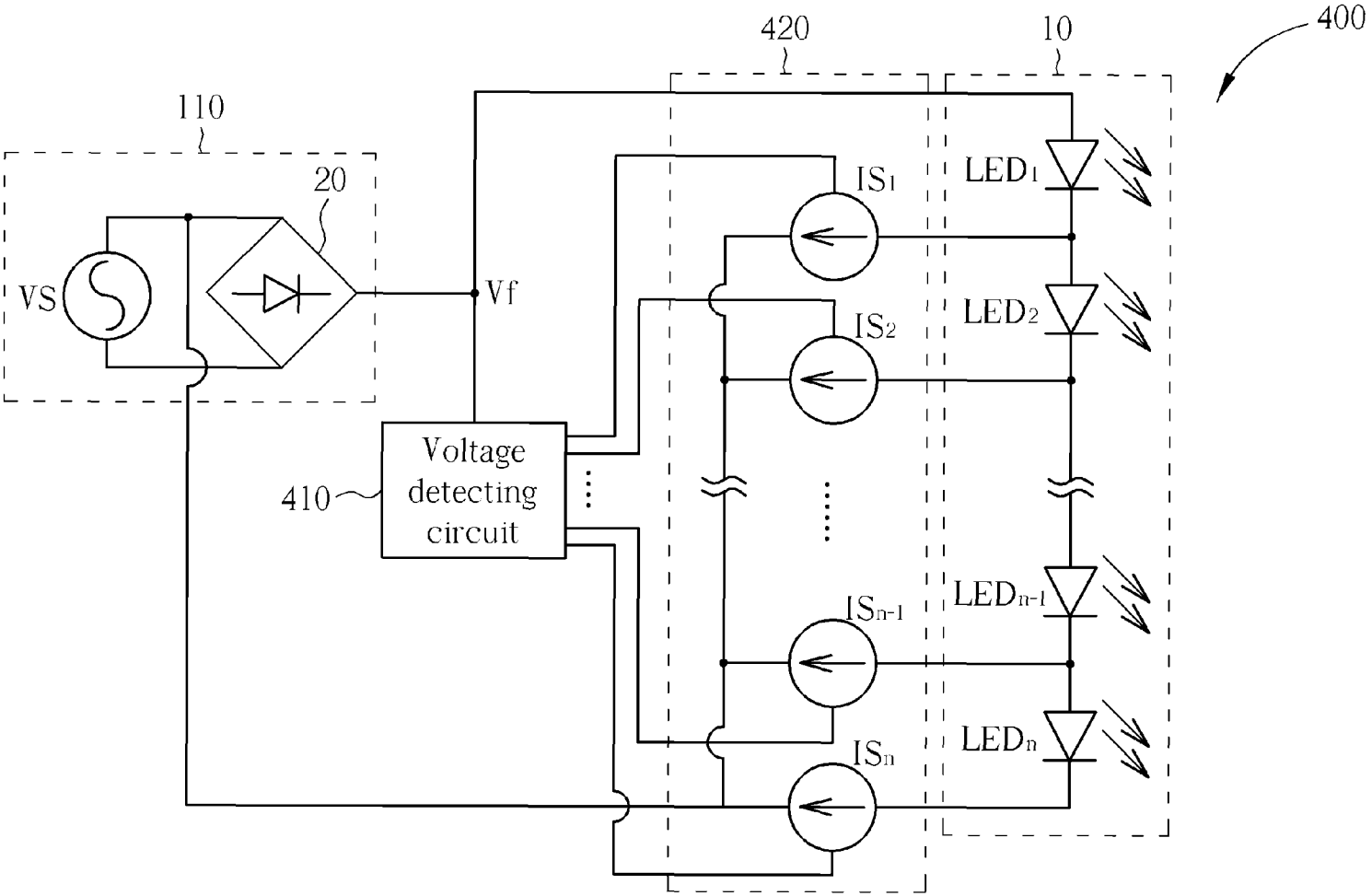
FIG. 3 PRIOR ART
FIG. 3 is a diagram of another prior art LED driving circuit.
Figure 4:
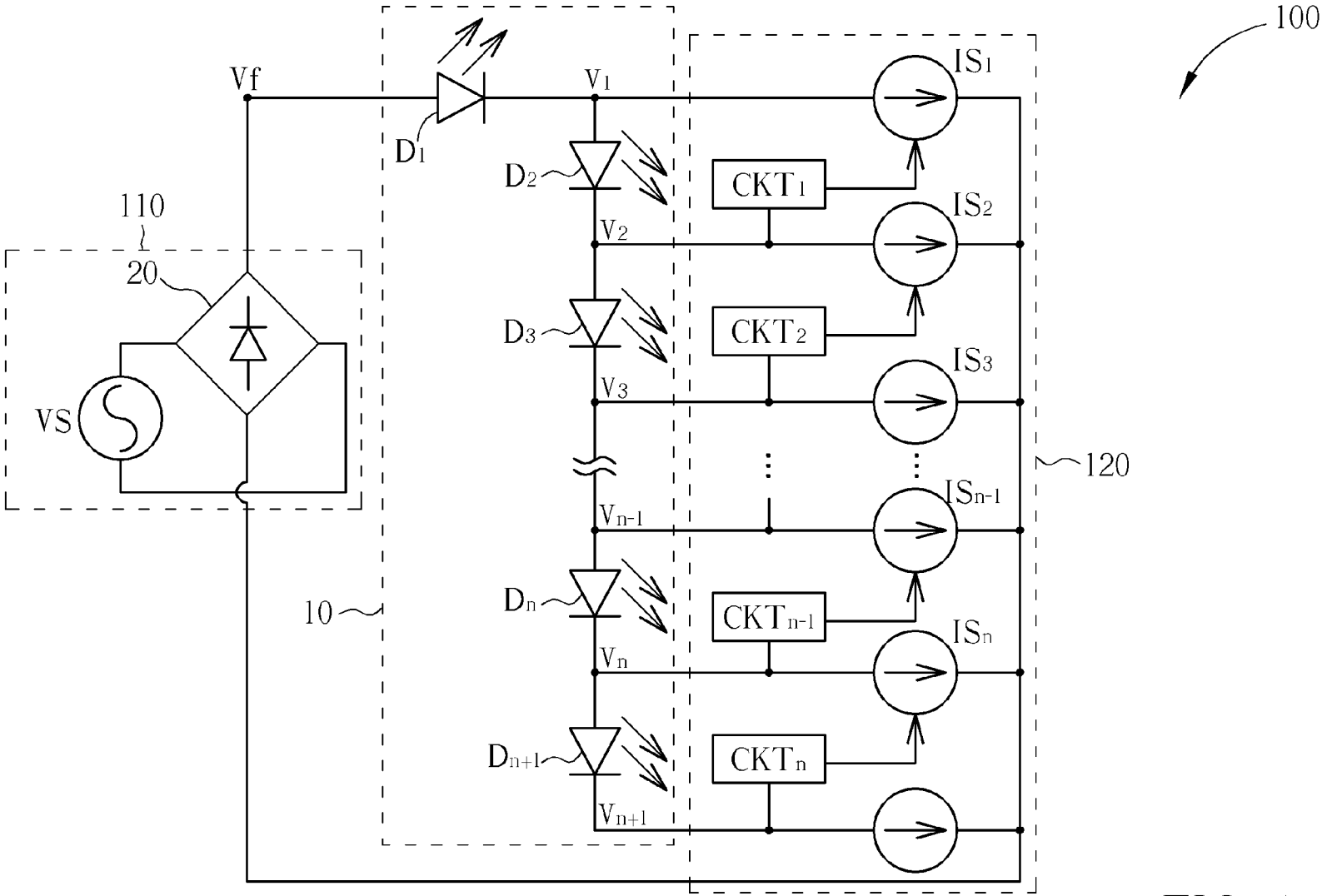
FIGS. 4 and 5 are diagrams illustrating LED driving circuits according to the embodiments of the present invention.
Figure 5:
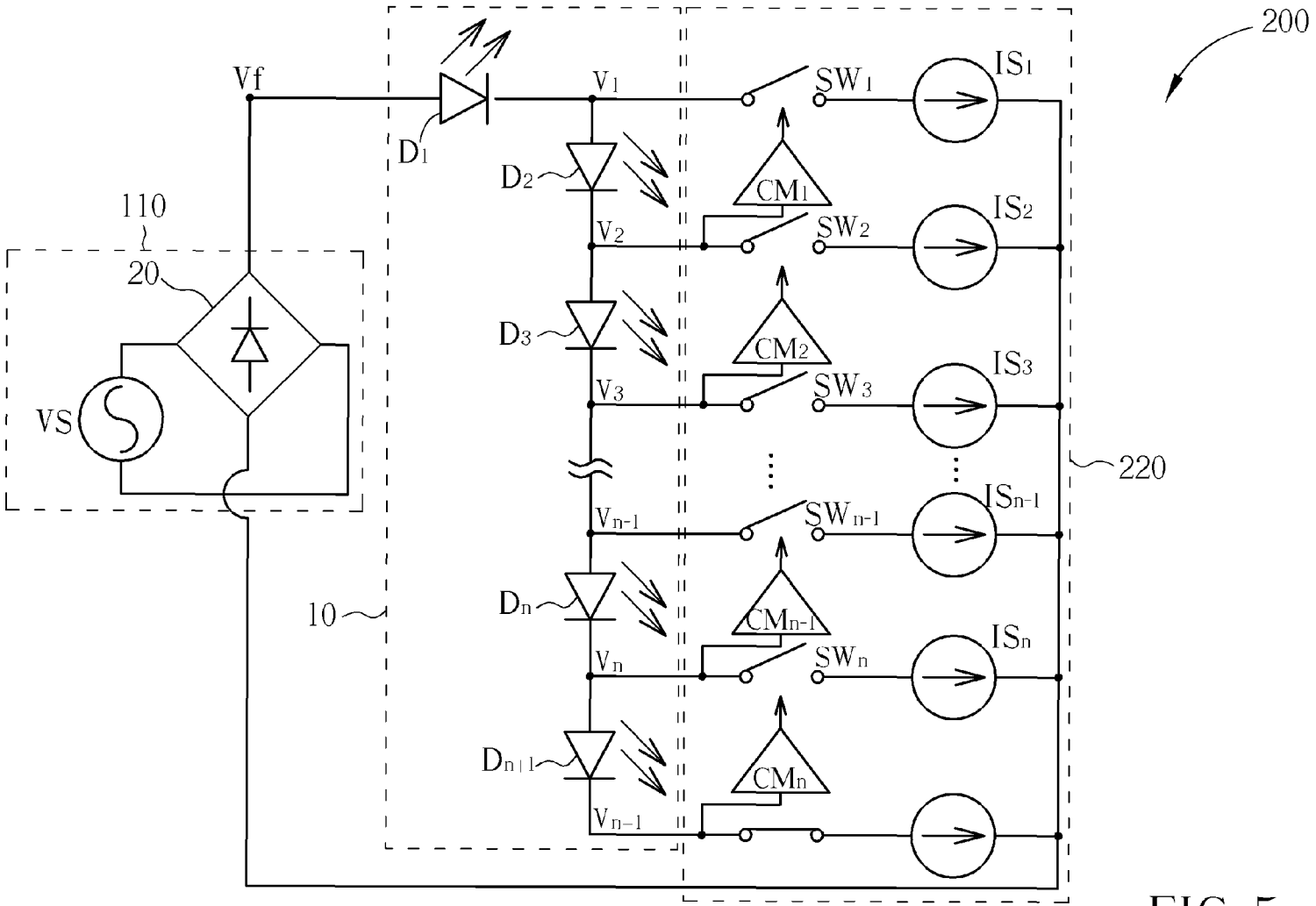

FIG. 4 is a diagram illustrating an LED driving circuit 100 according to a first embodiment of the present invention. FIG. 5 is a diagram illustrating an LED driving circuit 200 according to a second embodiment of the present invention. The LED driving circuit 100 having a current-selecting circuit 120 and the LED driving circuit 200 having a current-selecting circuit 220 are configured to drive a luminescent device 10 coupled in series with a power supply circuit 110.

The power supply circuit 110 includes a voltage source VS and a bridge rectifier 20. The voltage source VS can output an AC voltage which periodically switches between positive and negative phases, while the bridge rectifier 20 is configured to convert the AC voltage having negative phase. The power supply circuit 110 can thus provide a DC voltage Vf for driving the luminescent device 10, wherein the value of the driving voltage Vf periodically varies with time. The luminescent device 10 may include a plurality of luminescent units $D_1$-$D_{n+1}$ each having a single LED or multiple LEDs. For illustrative purpose, each luminescent unit depicted in FIG. 4 includes a single LED, but this structure does not limit the scope of the present invention. The voltages established between two adjacent luminescent units among the luminescent units $D_1$-$D_{n+1}$ are represented by $V_1$-$V_n$, respectively.

In the LED driving circuit 100 according to the first embodiment of the present invention, the current-selecting circuit 120 includes a plurality of variable current sources $IS_1$-$IS_n$ and a plurality of adjusting circuits $CKT_1$-$CKT_n$. The variable current sources $IS_1$-$IS_n$ provide adjustable current limits, based on which the currents flowing through the corresponding luminescent units $D_1$-$D_n$ are regulated at respective predetermined values, thereby providing brightness control and device protection. The adjusting circuits $CKT_1$-$CKT_n$ can respectively detect the values of the voltages $V_1$-$V_n$, thereby adjusting the current limits of the variable current sources $IS_1$-$IS_n$ accordingly.

As previously illustrated, the driving voltage Vf periodically varies with time. For illustration, assume that the driving voltage Vf gradually rises from 0 after initialization. When the voltage established across the luminescent unit $D_1$ exceeds the threshold voltage of the luminescent unit $D_1$, the luminescent unit $D_1$ is turned on, thereby providing a current path which starts from the voltage source VS and sequentially passes through the luminescent unit $D_1$ and the current sources $IS_1$. At this time, the current flowing through the luminescent unit $D_1$ is maintained at a constant value by the variable current source $IS_1$. Next, as the voltage $V_1$ increases with the driving voltage Vf, the luminescent unit $D_2$ is turned on when the voltage established across the luminescent unit $D_2$ exceeds the threshold voltage of the luminescent unit $D_2$. The adjusting circuit $CKT_1$ then detects the voltage $V_2$ or the current flowing through the luminescent unit $D_2$, thereby gradually lowering the current limit of the variable current source $IS_1$ to zero as the current flowing through the luminescent unit $D_2$ increases. At this time, the current path starts from the voltage source VS and sequentially passes through the luminescent unit $D_1$, the luminescent unit $D_2$ and the current sources $IS_2$, while the currents passing through the luminescent units $D_1$ and $D_2$ are maintained at respective constant values by the variable current sources $IS_1$ and $IS_2$, respectively. Similarly, as the driving voltage Vf gradually increases, the voltages $V_1$-$V_n$ also increase accordingly, thereby sequentially turning on the luminescent units $D_1$-$D_n$. On the other hand, the adjusting circuits $CKT_1$-$CKT_n$ respectively detect the voltages $V_2$-$V_n\pm_1$ or respectively detect the currents flowing through the luminescent units $D_2$-$D_{n+1}$, thereby sequentially lowering the current limits of the variable current sources $IS_1$-$IS_n$ to zero.

Assuming that when the driving voltage Vf provided by the power supply circuit 110 has a maximum value, all of the luminescent units $D_1$-$D_n$ are turned on and the current limits of the variable current sources $IS_1$-$IS_{n-1}$ are zero. At this time, the current path starts from the voltage source VS and sequentially passes through the luminescent unit $D_1$-$D_n$ and the current source $IS_n$, while the current passing through the luminescent units $D_1$-$D_n$ is maintained at a constant value by the variable current source $IS_n$. After the driving voltage Vf begins to decrease, the luminescent unit $D_n$ is the first to be turned off due to insufficient applied voltage. The adjusting circuit $CKT_{n-1}$ then detects the voltage $V_n$ or the current flowing through the luminescent unit $D_n$, thereby gradually raising the current limit of the variable current source $IS_{n-1}$ from zero. At this time, the current path starts from the voltage source VS and sequentially passes through the luminescent units $D_1$-$D_{n-1}$ and the current source $IS_{n-1}$, while the current flowing through the luminescent units $D_1$-$D_{n-1}$ is maintained at a constant value by the variable current source $IS_{n-1}$. Similarly, as the driving voltage Vf gradually decreases, the voltages $V_n$-$V_1$ also decrease accordingly, thereby turning off the luminescent units $D_n$-$D_1$ sequentially. On the other hand, the adjusting circuits $CKT_{n-1}$-$CKT_1$ respectively detect the voltages $V_n$-$V_2$ or respectively detect the currents passing through the luminescent units $D_n$-$D_1$, thereby sequentially increasing the current limits of the variable current sources $IS_{n-}$-$IS_1$.

In the LED driving circuit 200 according to the second embodiment of the present invention, the current-selecting circuit 220 includes a plurality of constant current sources $IS_1$-$IS_n$, a plurality of switches $SW_1$-$SW_n$ and a plurality of judging units $CM_1$-$CM_n$. The current sources $IS_1$-$IS_n$ provide constant current limits, based on which the currents flowing through the corresponding luminescent units $D_1$-$D_n$ are regulated at respective predetermined values, thereby providing brightness control and device protection. Each of the switches $SW_1$-$SW_n$ includes a first end coupled between two corresponding adjacent luminescent units among the luminescent units $D_1$-$D_n$ (respectively denoted by $V_1$-$V_n$), and a second end coupled to a corresponding current source among the current sources $IS_1$-$IS_n$. The judging units $CM_1$-$CM_n$ can respectively detect the values of the voltages $V_1$-$V_n$, thereby turning on/off the corresponding switches $SW_1$-$SW_n$ accordingly.

As previously illustrated, the driving voltage Vf periodically varies with time. For illustration, assuming that at initialization, the driving voltage Vf is equal to 0 and all switches $SW_1$-$SW_n$ are turned on (short-circuit). As the driving voltage Vf gradually increases, the luminescent unit $D_1$ is turned on when the voltage established across the luminescent unit $D_1$ exceeds the threshold voltage of the luminescent unit $D_1$, while the luminescent unit $D_2$ remains off. At the time, the current path starts from the voltage source VS and sequentially passes through the luminescent unit $D_1$, the switch $SW_1$ and the current source $IS_1$, while the current flowing through the luminescent unit $D_1$ is maintained at a constant value by the current source $IS_1$. Next, as the voltage $V_1$ increases with the driving voltage Vf, the luminescent unit $D_2$ is turned on when the voltage established across the luminescent unit $D_2$ exceeds the threshold voltage of the luminescent unit $D_2$, while the luminescent unit $D_3$ remains off. At the time, the voltage $V_2$ also increases with the driving voltage Vf. After having detected that the voltage $V_2$ has reached a predetermined value, the judging unit $CM_1$ turns off the switch $SW_1$. At this time, the current path starts from the voltage source VS and sequentially passes through the luminescent unit $D_1$, the luminescent unit $D_2$, the switch $SW_2$ and the current source $IS_2$, while the current flowing through the luminescent unit $D_1$-$D_2$ is maintained at a constant value by the current source $IS_2$. Similarly, as the driving voltage Vf gradually increases, the voltages $V_1$-$V_n$ also increase accordingly, thereby sequentially turning on the luminescent units $D_1$-$D_n$. On the other hand, the judging units $CM_1$-$CM_n$ respectively determine whether the voltages $V_2$-$V_{n+1}$ have reached respective predetermined values, thereby sequentially turning off the switches $SW_1$-$SW_n$.

Assuming that when the driving voltage Vf provided by the power supply circuit 110 has a maximum value, the luminescent units $D_1$-$D_n$ are turned on (short-circuit), the switches $SW_1$-$SW_{n-1}$ are turned off (open-circuit), and the switch $SW_n$ is turned on. At this time, the current path starts from the voltage source VS and sequentially passes through the luminescent unit $D_1$-$D_n$, the switch $SW_n$ and the current source $IS_n$, while the current passing through the luminescent units $D_1$-$D_n$ is maintained at a constant value by the current source $IS_n$. As the voltage $V_n$ decreases with the driving voltage Vf and falls to a predetermined value, the judging unit $CM_{n-1}$ turns on the switch $SW_{n-1}$ and the luminescent unit $D_n$ is turned off due to insufficient applied voltage. At this time, the current path starts from the voltage source VS and sequentially passes through the luminescent unit $D_1$-$D_{n-1}$, the switch $SW_{n-1}$ and the current source $IS_{n-1}$, while the current passing through the luminescent units $D_1$-$D_{n-1}$ is maintained at a constant value by the current source $IS_{n-1}$. Similarly, as the driving voltage Vf gradually decreases, the voltages $V_n$-$V_1$ also decrease accordingly, thereby turning off the luminescent units $D_n$-$D_1$ sequentially. On the other hand, the judging units $CM_{n-1}$-$CM_1$ respectively determine whether the voltages $V_n$-$V_2$ have reached respective predetermined values, and sequentially turn off the $SW_{n-1}$-$SW_1$. On the other hand, the luminescent units $D_n$-$D_1$ are also sequentially turned off as respective applied voltages gradually drop.

Figure 6:
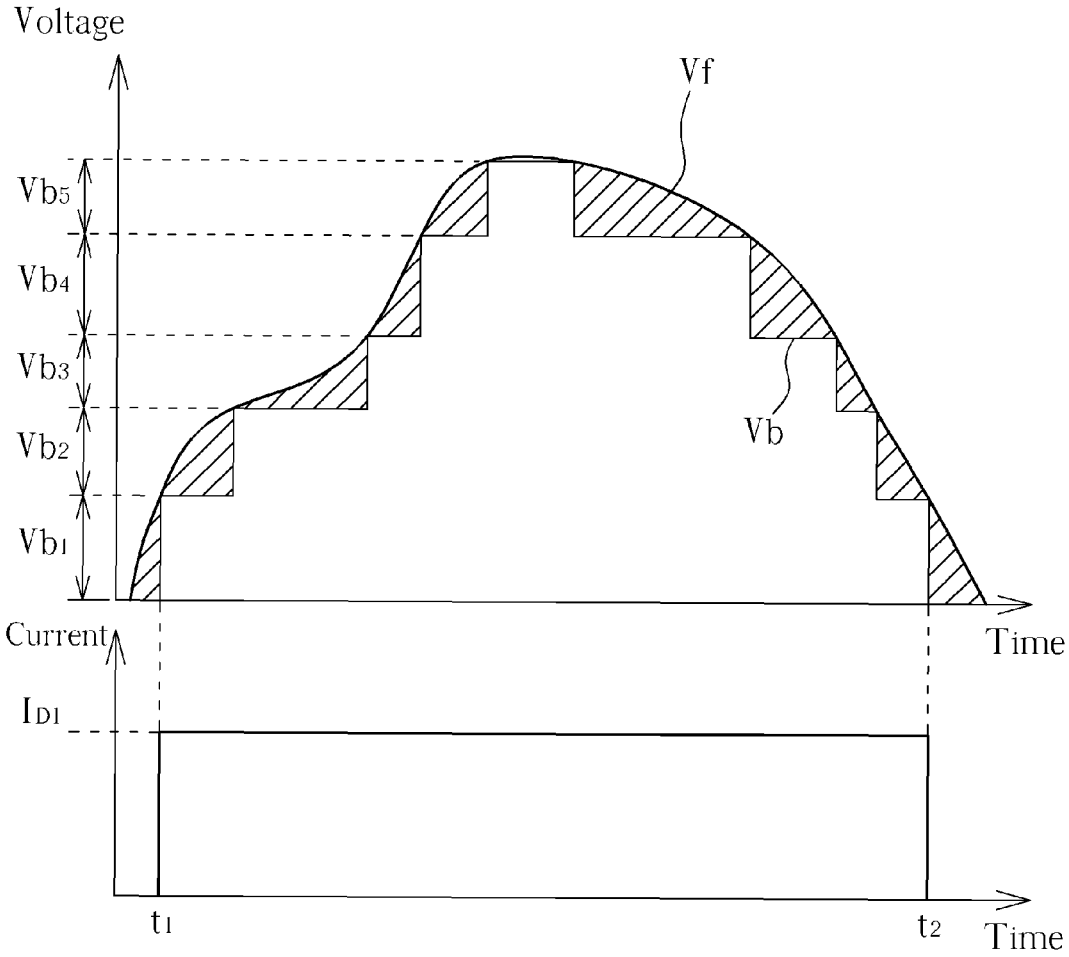
FIG. 6 is a diagram illustrating the operation of an LED driving circuit according to the present invention.

Reference is made to FIG. 6 for a diagram illustrating the operation of the LED driving circuit 100 or 200 according to the present invention. Assuming that the LED driving circuit 100 or 200 includes five current sources $IS_1$-$IS_5$ which provide identical current limit, and the luminescent device 10 includes five luminescent units $D_1$-$D_5$ whose threshold voltages are respectively represented by $Vb_1$-$Vb_5$. In FIG. 6, Vf represents the DC voltage provided by the power supply circuit 110, Vb represents the overall voltage established across all the turned-on luminescent units among the luminescent units $D_1$-$D_5$, and $I_{D1}$ represents the current flowing through the luminescent unit $D_1$. As shown in FIG. 6, the present invention can provide a large operational voltage range (between t1 and t2), as well as can reduce the power consumption of the current sources $IS_1$-$IS_5$ (the differences between Vf and Vb, denoted by dotted regions in FIG. 6).

In conclusion, the present invention can control the current limit of each current source according to the actual threshold voltage of the corresponding luminescent unit, such as the digital adjustment provided by the current-selecting circuit 120 of the first embodiment or the analog adjustment provided by the current-selecting circuit 220 of the second embodiment. The current paths in the LED string can be controlled based on the threshold voltage of each LED without using filter capacitor or detecting the input voltage. Even the LEDS of each luminescent unit may have different threshold voltages, the present invention can still provide accurate current limits accordingly, thereby enlarging the effective operational voltage range and improving optical efficiency and power factor.

Those skilled in the art will readily observe that numerous modifications and alterations of the device and method may be made while retaining the teachings of the invention.

What is claimed is:

1. A driving circuit having a large operational voltage range and configured to drive a plurality of serially-coupled luminescent units, the driving circuit comprising:

a current-selecting circuit configured to control current paths in the plurality of luminescent units according to a plurality of current limits and respective threshold voltages of corresponding light emitting diodes in the plurality of luminescent units;

wherein the current-selecting circuit comprises:

a plurality of current sources respectively configured to provide the plurality of current limits; and a plurality of adjusting circuits respectively configured to adjust the plurality of current limits according to voltages established between two corresponding adjacent luminescent units among the plurality luminescent units.

2. The driving circuit of claim 1, wherein the plurality of current sources are variable current sources.

3. The driving circuit of claim 1, wherein the current-selecting circuit and the plurality of serially-coupled luminescent units are arranged in a matrix.

4. The driving circuit of claim 1, wherein each luminescent unit includes a light emitting diode (LED).

5. The driving circuit of claim 1, wherein each luminescent unit includes a plurality of serially-coupled LEDs.

6. A driving circuit having a large operational voltage range and configured to drive a plurality of serially-coupled luminescent units, the driving circuit comprising:

a current-selecting circuit configured to control current paths in the plurality of luminescent units according to a plurality of current limits and respective threshold voltages of corresponding light emitting diodes in the plurality of luminescent units;

wherein the current-selecting circuit comprises:

a plurality of current sources respectively configured to provide the plurality of current limits;

a plurality of judging units respectively configured to generate a plurality of switch control signals according to voltages established between two corresponding adjacent luminescent units among the plurality luminescent units; and a plurality of switches respectively configured to control signal transmission paths between the plurality of current sources and the plurality luminescent units according to the plurality of switch control signals.

7. The driving circuit of claim 6, wherein the plurality of current sources are constant current sources.

8. A display device having a large operational voltage range and comprising:

a plurality of serially-coupled luminescent units;

a power supply circuit coupled to plurality of serially-coupled luminescent units; and a driving circuit configured to drive the plurality of serially-coupled luminescent units, the driving circuit comprising:

a current-selecting circuit configured to control current paths in the plurality of luminescent units according to a plurality of current limits and respective threshold voltages of corresponding light emitting diodes in the plurality of luminescent units;

wherein the current-selecting circuit comprises:

a plurality of current sources respectively configured to provide the plurality of current limits; and a plurality of adjusting circuits respectively configured to adjust the plurality of current limits according to voltages established between two corresponding adjacent luminescent units among the plurality luminescent units.

9. The display device of claim 8, wherein the plurality of current sources are variable current sources.

10. The display device of claim 8, wherein the current-selecting circuit and the plurality of serially-coupled luminescent units are arranged in a matrix.

11. The display device of claim 8, wherein the power supply circuit comprises:

a power source configured to provide an alternative current (AC) voltage which periodically switches between positive and negative phases; and a bridge rectifier configured to convert the AC voltage outputted in the negative phase, thereby providing a direct current (DC) voltage for driving the plurality of serially-coupled luminescent units.

12. The display device of claim 8, wherein each luminescent unit includes an LED.

13. The display device of claim 8, wherein each luminescent unit includes a plurality of serially-coupled LEDs.

14. A display device having a large operational voltage range and comprising:

a plurality of serially-coupled luminescent units;

a power supply circuit coupled to plurality of serially-coupled luminescent units; and a driving circuit configured to drive the plurality of serially-coupled luminescent units, the driving circuit comprising:

a current-selecting circuit configured to control current paths in the plurality of luminescent units according to a plurality of current limits and respective threshold voltages of corresponding light emitting diodes in the plurality of luminescent units;

wherein the current-selecting circuit comprises:

a plurality of current sources respectively configured to provide the plurality of current limits;

a plurality of judging units respectively configured to generate a plurality of switch control signals according to voltages established between two corresponding adjacent luminescent units among the plurality luminescent units; and a plurality of switches respectively configured to control signal transmission paths between the plurality of current sources and the plurality luminescent units according to the plurality of switch control signals.

15. The display device of claim 14, wherein the plurality of current sources are constant current sources.

* * * * *